US007022030B2

(12) United States Patent
Best et al.

(10) Patent No.: US 7,022,030 B2
(45) **Date of Patent: *Apr. 4, 2006**

(54) GOLF CLUB HEAD

(75) Inventors: Christopher B. Best, Encinitas, CA (US); Robert D. Hirsch, Bonsall, CA (US); Philamon W. Rodgers, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/637,530

(22) Filed: Aug. 11, 2003

(65) Prior Publication Data

US 2005/0037857 A1 Feb. 17, 2005

(51) Int. Cl.
*A63B 53/04* (2006.01)

(52) U.S. Cl. ..... 473/340

(58) Field of Classification Search ..... 473/251–255, 473/340–341, 343, 345
See application file for complete search history.

(56) References Cited

U.S. PATENT DOCUMENTS

| | | | | |
|---|---|---|---|---|
| 1,289,192 | A * | 12/1918 | Klin | 473/343 |
| 3,966,210 | A * | 6/1976 | Rozmus | 473/341 |
| 4,962,931 | A | 10/1990 | Jazdzyk, Jr. | 273/164 |
| 4,986,544 | A | 1/1991 | Benson | 273/183 |
| 5,709,616 | A * | 1/1998 | Rife | 473/330 |
| 5,876,293 | A | 3/1999 | Musty | 473/341 |
| 6,048,275 | A * | 4/2000 | Gedeon | 473/293 |
| 6,394,910 | B1 | 5/2002 | McCarthy | 473/251 |
| 6,558,268 | B1 | 5/2003 | Tindale | 473/244 |
| 6,607,452 | B1 * | 8/2003 | Helmstetter et al. | 473/345 |
| 6,743,112 | B1 * | 6/2004 | Nelson | 473/251 |
| 2002/0013180 | A1 * | 1/2002 | Kajita | 473/330 |
| 2002/0103039 | A1 * | 8/2002 | Shmoldas et al. | 473/251 |
| 2003/0045373 | A1 * | 3/2003 | Field | 473/340 |
| 2003/0207722 | A1 * | 11/2003 | Hess et al. | 473/282 |
| 2004/0063516 | A1 * | 4/2004 | Cameron | 473/340 |
| 2004/0173964 | A1 * | 9/2004 | Pollman | 273/252 |

FOREIGN PATENT DOCUMENTS

JP 2003-70941 * 3/2003

* cited by examiner

*Primary Examiner*—Stephen Blau
(74) *Attorney, Agent, or Firm*—Swidler Berlin LLP

(57) ABSTRACT

A golf club head is disclosed. The golf club head includes a first body member and a second body member. The first body member includes a strike face and a top portion. The second body member is coupled to the first body member and extends away from the first body member in a direction opposite the strike face. At least a top portion of the second body member is camouflaged. A preferred method of camouflage is color differentiation, wherein the second body member is darker than the first body member. Specific color values and club head geometries are also disclosed and claimed.

34 Claims, 4 Drawing Sheets

GOLF CLUB HEAD

BACKGROUND OF THE INVENTION

1. Field of the Invention

The present invention relates to a golf club head. In particular, the present invention relates to a golf club head having two body members, one of which being camouflaged. More particularly, the present invention relates to a golf club head having two body members of differing color.

2. Description of the Related Art

There are many styles of putters, including blades, mallets, heel-toe weighted, and T-line putters. Different types of putters provide different advantages. For example, increasing the club head moment of inertia (MOI) and moving the center of gravity away from the strike face can increase the forgiveness and accuracy of putters. Heel-toe weighted putters also increase the MOI to provide forgiveness on off-center hits.

However, some of these putter designs produce large putter club heads. While these designs have improved putter performance, they have largely ignored aesthetic considerations. An extended club body may have the deleterious effect of distracting the user. This is particularly undesirable in golf, since golf is a very "mental" sport.

Thus, what is needed is an improved golf club head that allows for technical improvements but that does not distract the golfer during use.

SUMMARY OF THE INVENTION

The golf club head of the present invention solves the deficiencies identified above. The golf club head of the present invention has a first body member and a second body member. The second body member can be integral with the first body member, or it can be independent of and coupled to the first body member. The first body member has a strike face, which may be either integral with the first body member or independent of and coupled to the first body member. The second body member extends away from the first body member in a direction opposite the strike face. A weight member may be coupled to the second body member, or the second body member may have a greater specific gravity than the first body member. The golf club preferably is a putter.

The second body member is preferably camouflaged. This may be done by making the top portion of the second body member a darker color than the top portion of the first body member. The second body member top portion is preferably substantially black, and the first body member top portion is preferably substantially grey.

The first body member top portion is preferably a first color having an L* value of approximately 35 to approximately 100. The second body member top portion is preferably a second color having an L* value of approximately 2 to approximately 35. The first color L* value is more preferably approximately 40 to approximately 60, and still more preferably approximately 45. The second color L* value is more preferably approximately 20 to approximately 30, and still more preferably approximately 25. Alternatively, the first L* value is preferably approximately one-and-a-quarter to two times the second L* value, and more preferably approximately one-and-a-half times the second L* value.

The first body member top portion has a first area and the second body member top portion has a second area, the first and second areas combining to form a total top area for the club head. The first area comprises approximately 20% to approximately 80% of the total top area, and the second area comprises approximately 20% to approximately 80% of the total top area. More preferably, the first area comprises approximately two-thirds of the total top area and the second area comprises approximately one-third of the total top area.

The first area has a first depth and the second area has a second depth, the depths measured in the face-to-rear direction. The second depth is preferably approximately one-half to approximately two times the first depth. More preferably, the second depth is approximately two-thirds times the first depth.

The golf club head has a width, measured in the toe-to-heel direction. The first depth is preferably approximately one-half to approximately one times the width, and more preferably approximately two-thirds times the width. The first depth plus the second depth is approximately one-half to one times the width, and more preferably approximately three-quarters to approximately one times the width.

The golf club head has a center of gravity. The center of gravity is preferably located a distance of approximately one inch to approximately five inches back from the strike face. More preferably, the center of gravity is located a distance of approximately two inches to approximately four inches back from the strike face. Still more preferably, the center of gravity is located a distance of approximately three-and-three-quarters inches back from the strike face.

The golf club head has a MOI measured about a substantially vertical axis passing through the center of gravity when the golf club head is on a substantially horizontal surface. The MOI is preferably approximately 4000 $g \cdot cm^2$ to approximately 6000 $g \cdot cm^2$, and is more preferably approximately 4750 $g \cdot cm^2$ to 5250 $g \cdot cm^2$.

The golf club head has a MOI measured about an axis passing through the center of gravity that is substantially horizontal and perpendicular to the strike face when the golf club head is on a substantially horizontal surface. The MOI is preferably approximately 2500 $g \cdot cm^2$ to approximately 4500 $g \cdot cm^2$, and is more preferably approximately 2800 $g \cdot cm^2$ to 3500 $g \cdot cm^2$.

The golf club head has a MOI measured about an axis passing through the center of gravity that is substantially horizontal and parallel to the strike face when the golf club head is on a substantially horizontal surface. The MOI is preferably approximately 2000 $g \cdot cm^2$ to approximately 3000 $g \cdot cm^2$, and is more preferably approximately 2300 $g \cdot cm^2$ to 2500 $g \cdot cm^2$.

The golf club head may include a sight line to help the user line up the golf shot. The sight line may be on only the first body member, or it may be on both the first and second body members.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
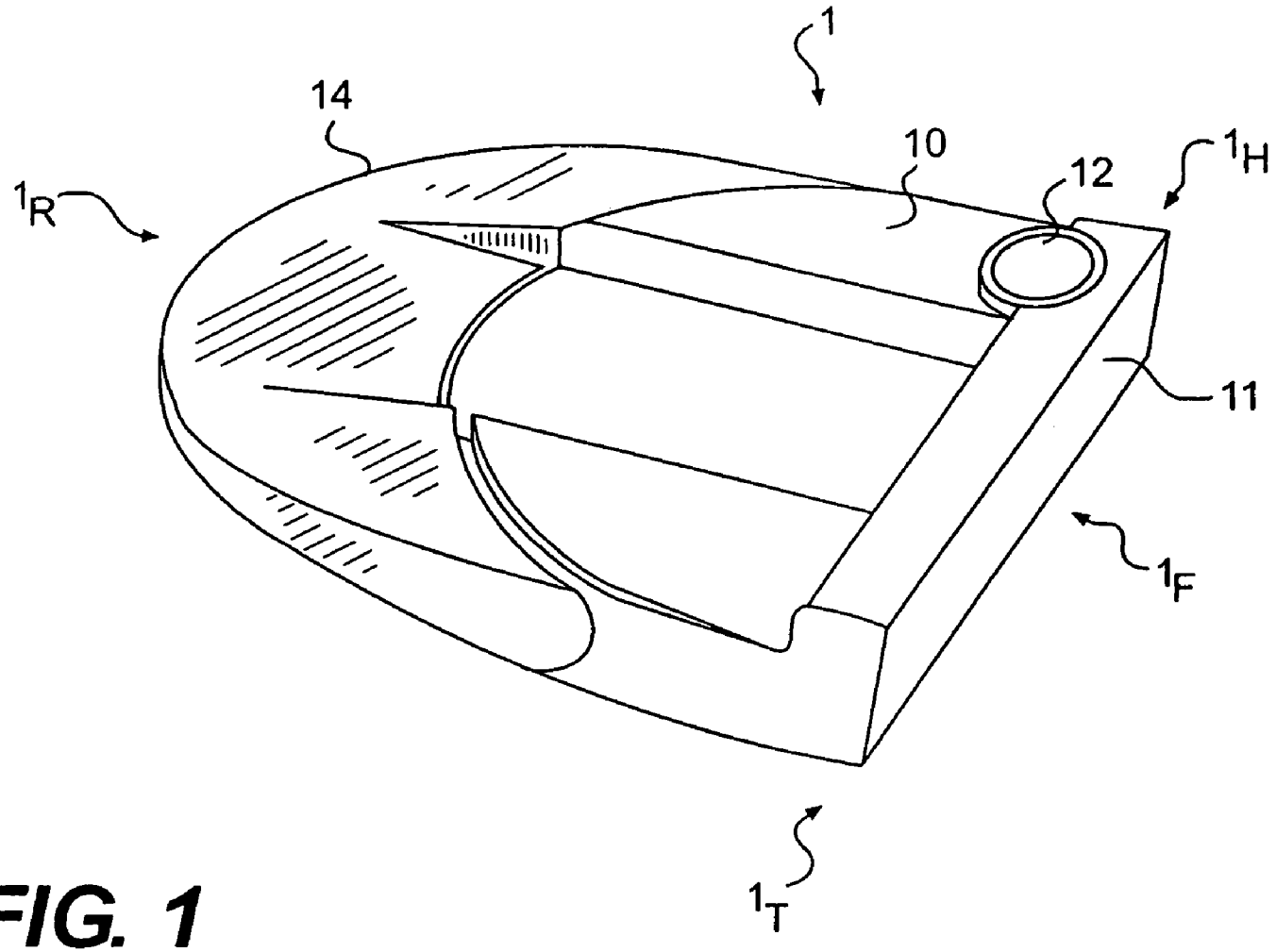
FIG. 1 shows a top view of a golf club head of the present invention.

FIG. 1 shows a top view of a golf club head 1 of the present invention. The illustrated golf club is a putter. Club head 1 includes a first body member 10 and a second body member 14. First body member 10 includes a strike face 11 that contacts a golf ball during normal use. Strike face 11 may be integral with first body member 10. Alternatively, strike face 11 may be independent of and coupled to first body member 10. Preferred means of coupling include use of an adhesive, brazing, and welding. Other coupling means, such as mechanical fasteners, may also be used. Furthermore, a combination of these coupling modes could be used. First body member 10 contains a bore 12 for connecting a shaft thereto. Club head 1 has a heel $\mathbf{1}_H$, a toe $\mathbf{1}_T$, a face $\mathbf{1}_F$, and a rear $\mathbf{1}_R$.

Second body member 14 extends away from a rearward portion of first body member 10. Second body member 14 is preferably integral with first body member 10. Alternatively, second body member 14 may be independent of and coupled to first body member 10 in known fashion. Second body member 14 may have a weight member 18 coupled thereto. In lieu of a separate weight member 18, second body member 14 may optionally have a greater specific gravity than first body member 10.

Inclusion of second body member 14 moves the club head center of gravity backward, away from strike face 11. Moving the center of gravity backward allows for a smoother putting stroke, allowing the user to more fluidly contact the golf ball. It additionally increases the club head MOI, which helps to keep the club stable during use, which is especially beneficial during off-center hits.

An extended club body, however, may have the deleterious effect of distracting the user. This is particularly undesirable in golf, since golf is a very "mental" sport. Thus, second body member 14 is preferably camouflaged such that it is less noticeable and therefore less distracting to a golfer during use.

Figure 2:
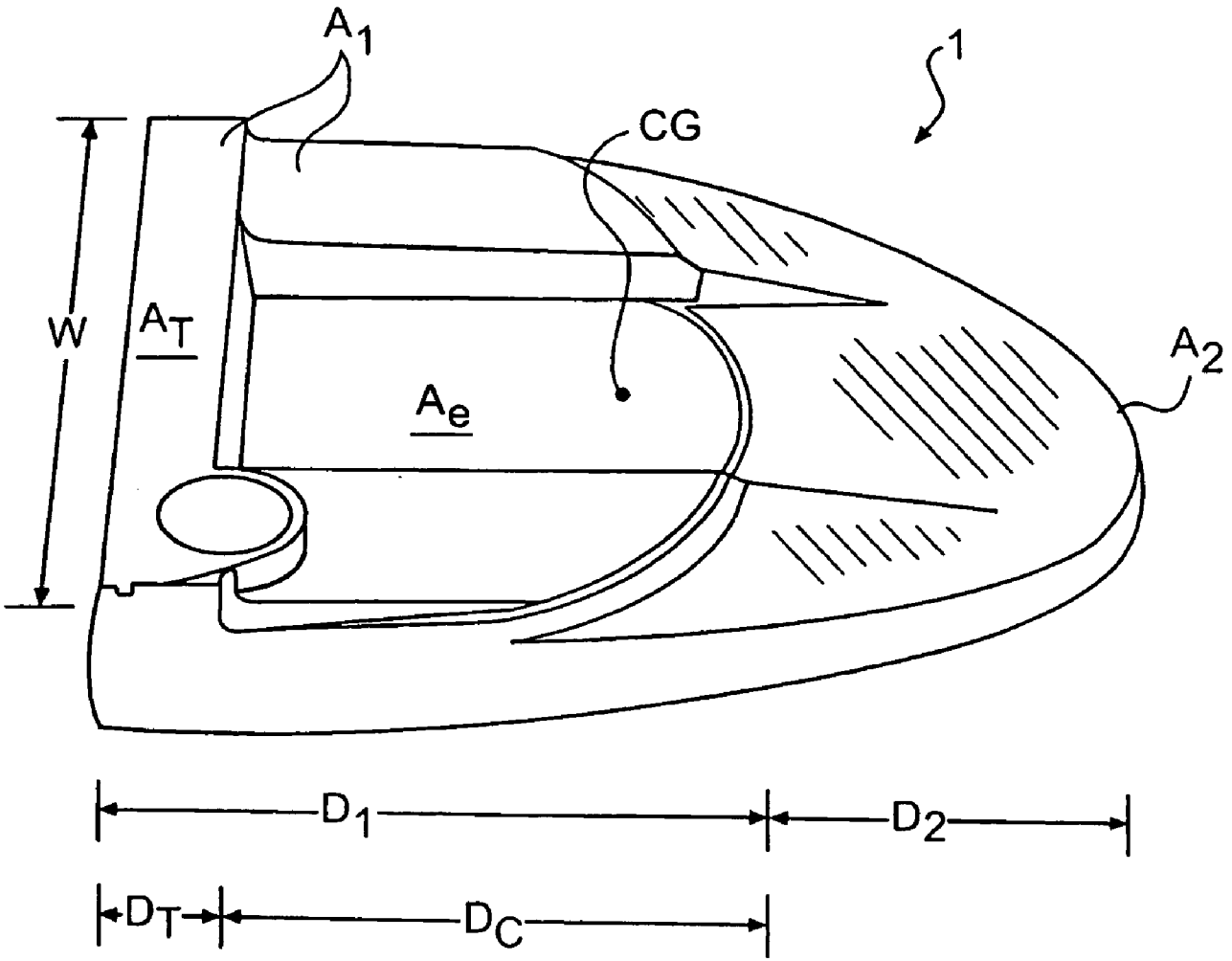
FIG. 2 shows another top view of a golf club head of the present invention.
Figure 3:
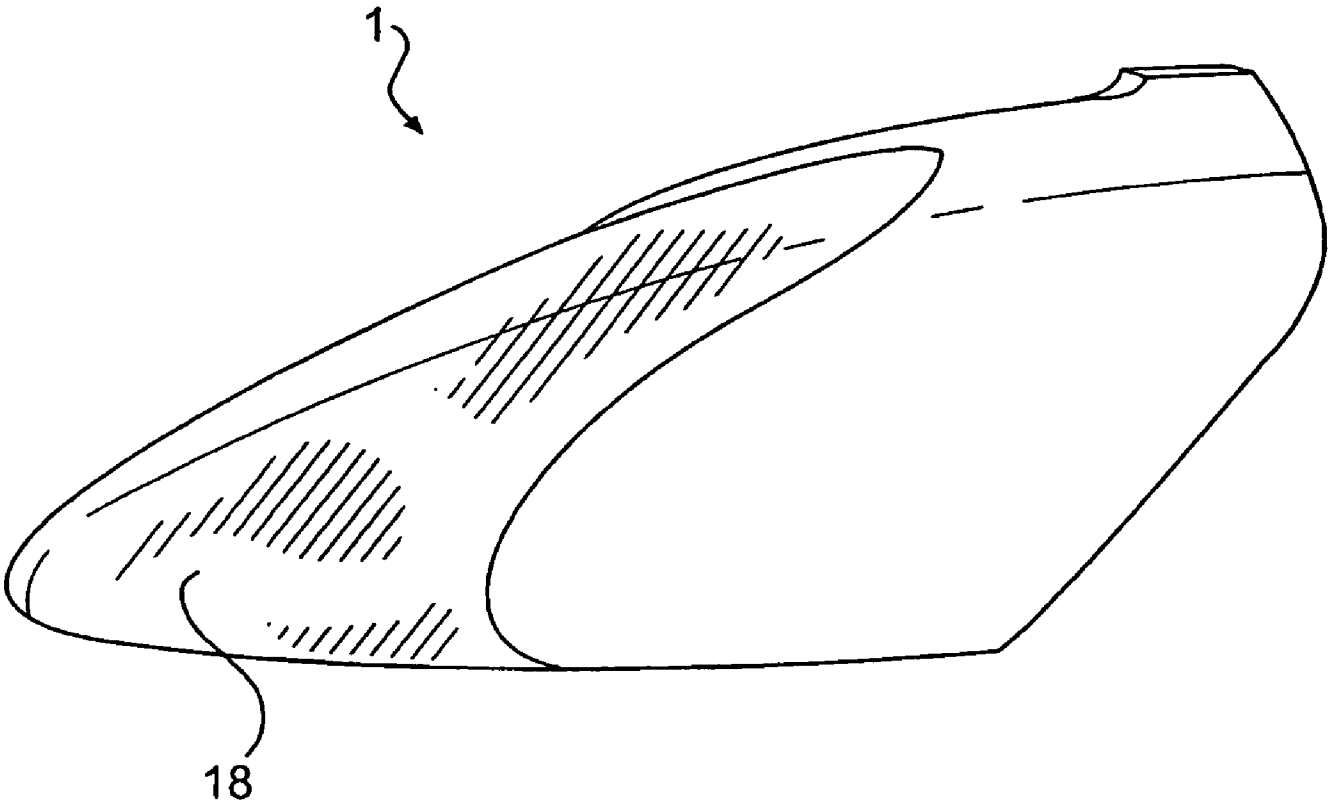
FIG. 3 shows a bottom view of a golf club head of the present invention.

A preferred method of camouflage is color differentiation. First body member 10 is of a first color, and second body member 14 is of a second color. The colors may comprise the entire outer portions of body members 10, 14, as shown in FIG. 1. Alternatively, the colors may comprise only the top portions of body members 10, 14, as shown in FIG. 2.

The second color is darker than the first color. In addition to inherently drawing one's attention to first body member 10, making second body member 14 darker also tends to make it blend into the background (the golf green for a putter). Preferably, the second color is substantially darker than the first color. More preferably, the first color is substantially grey and the second color is substantially black.

A convenient way of categorizing color and expressing colors numerically is through the CIELCh system. The CIELCh system is a standard color system that is well known in the arts of color and appearance to describe the effective color of an object. The CIELCh system defines color by three values on a cylindrical polar coordinate system—L*, C*, and h°. L* defines lightness, C* specifies chroma, and h° denotes hue angle. The CIELCh values indicate both magnitude and direction of color definition. An L* value of 0 is pure black, or complete absorption of all wavelengths of light. An L* value of 100 is pure white, or complete reflection of all wavelengths of light. Thus, 0 is the minimum L* value and 100 is the maximum L* value.

L* is calculated by the following equation: $L^* = 116(Y/Yn)^{1/3} - 16$, where Yn is a value for a reference white and Y relates to the measured color's value in the CIELCh coordinate system.

The first color preferably has an L* value of approximately 35 to approximately 100. The second color preferably has an L* value of approximately 2 to approximately 35. More preferably, the first color has an L* value of approximately 40 to approximately 60, and the second color has an L* value of approximately 20 to approximately 30. Still more preferably, the first color has an L* value of approximately 45, and the second color has an L* value of approximately 25.

Alternatively, the brightness values of the first and second colors can be defined by percent difference. First body member 10 has a first L* value and second body member 14 has a second L* value. Preferably, the first L* value is approximately one-and-a-quarter to two times the second L* value. More preferably, the first L* value is approximately one-and-a-half times the second L* value. As discussed above, at least the top portions of body members 10, 14 are colored.

As shown in FIG. 2, first body member 10 has a top portion of a first area $A_1$ and second body member 14 has a top portion of a second area $A_2$. First area $A_1$ and second area $A_2$ combine to form a total top area for the club head. The percentages of the total top area covered by first area $A_1$ and second area $A_2$ determine how club head 1 will appear in its camouflaged state to the user. Since the purpose is to make club head 1 appear as a conventional club head, first area Al preferably comprises approximately 20% to approximately 80% of the total top area and second area $A_2$ preferably comprises approximately 20% to approximately 80% of the total top area. More preferably, first area $A_1$ comprises approximately two-thirds of the total top area and second area $A_2$ comprises approximately one-third of the total top area.

The spatial relationship between first body member 10 and second body member 14 may alternatively be categorized by the depths of each area $A_1$, $A_2$. First area $A_1$ has a first depth $D_1$ and second area $A_2$ has a second depth $D_2$, depths $D_1$, $D_2$ measured in the face-to-rear direction. Second depth $D_2$ is preferably approximately one-half to approximately two times first depth $D_1$. More preferably, second depth $D_2$ is approximately two-thirds of first depth $D_1$.

The spatial relationship between first body member 10 and second body member 14 may alternatively be categorized by depths $D_1$, $D_2$ with respect to the width of club head 1. Club head 1 has a width W measured in the toe-to-heel direction. First depth $D_1$ is preferably approximately one-half to approximately one times width W, and is more preferably approximately two-thirds times width W. First depth $D_1$ plus second depth $D_2$ is approximately one-half to one times width W, and is more preferably approximately three-quarters to approximately one times width W.

First area $A_1$ may be divided into a toe area $A_T$ having a toe depth DT and a crown area $A_C$ having a crown depth $D_C$. Toe area $A_T$ and crown area $A_C$ combine to form first area $A_1$, and toe depth $D_T$ and crown depth $D_C$ combine to form first depth $D_1$. Toe area $A_T$ preferably comprises approximately 10% to approximately 50% of the total top area.

When a club, such as a putter, strikes a ball off-center, there is a tendency for the club to rotate about a substantially vertical axis passing through the club head center of gravity. This club rotation causes the shot or putt to deviate from the intended course by either a push/pull (straight ball path), slice/hook (curved ball path), or combination thereof. Moving the center of gravity further back in the club head creates a greater resistance to this rotation.

Increasing a club head's MOI also creates resistance to club head rotation. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases.

Inclusion of second body member 14 moves the center of gravity CG of club head 1 away from face $\mathbf{1}_F$ and towards rear $\mathbf{1}_R$. This is enhanced by inclusion of weight member 18 and/or increasing the specific gravity of second body member 14. Thus, second body member 14 increases the resistance to club head rotation and creates more accurate off-center shots.

Center of gravity CG is preferably located a distance of approximately one inch to approximately five inches back from strike face 11. More preferably, center of gravity CG is located a distance of approximately two inches to approximately four inches back from strike face 11. Still more preferably, center of gravity CG is located a distance of approximately three-and-three-quarters inches back from strike face 11.

Club head 1 has a MOI measured about a substantially vertical axis passing through the center of gravity when the golf club head is on a substantially horizontal surface. The MOI is preferably approximately 4000 $g \cdot cm^2$ to approximately 6000 $g \cdot cm^2$, and is more preferably approximately 4750 $g \cdot cm^2$ to 5250 $g \cdot cm^2$.

Inclusion of second body member 14 increases the MOI about the other axes as well. These increased MOI's increase the stability of club head 1. Club head 1 has a MOI measured about an axis passing through the center of gravity CG that is substantially horizontal and perpendicular to the strike face when the golf club head is on a substantially horizontal surface. The MOI is preferably approximately 2000 $g \cdot cm^2$ to approximately 3000 $g \cdot cm^2$, and is more preferably approximately 2300 $g \cdot cm^2$ to 2500 $g \cdot cm^2$. Club head 1 has a MOI measured about an axis passing through the center of gravity CG that is substantially horizontal and parallel to the strike face when the golf club head is on a substantially horizontal surface. The MOI is preferably approximately 2500 $g \cdot cm^2$ to approximately 4500 $g \cdot cm^2$, and is more preferably approximately 2800 $g \cdot cm^2$ to 3500 $g \cdot cm^2$.

Figure 4:
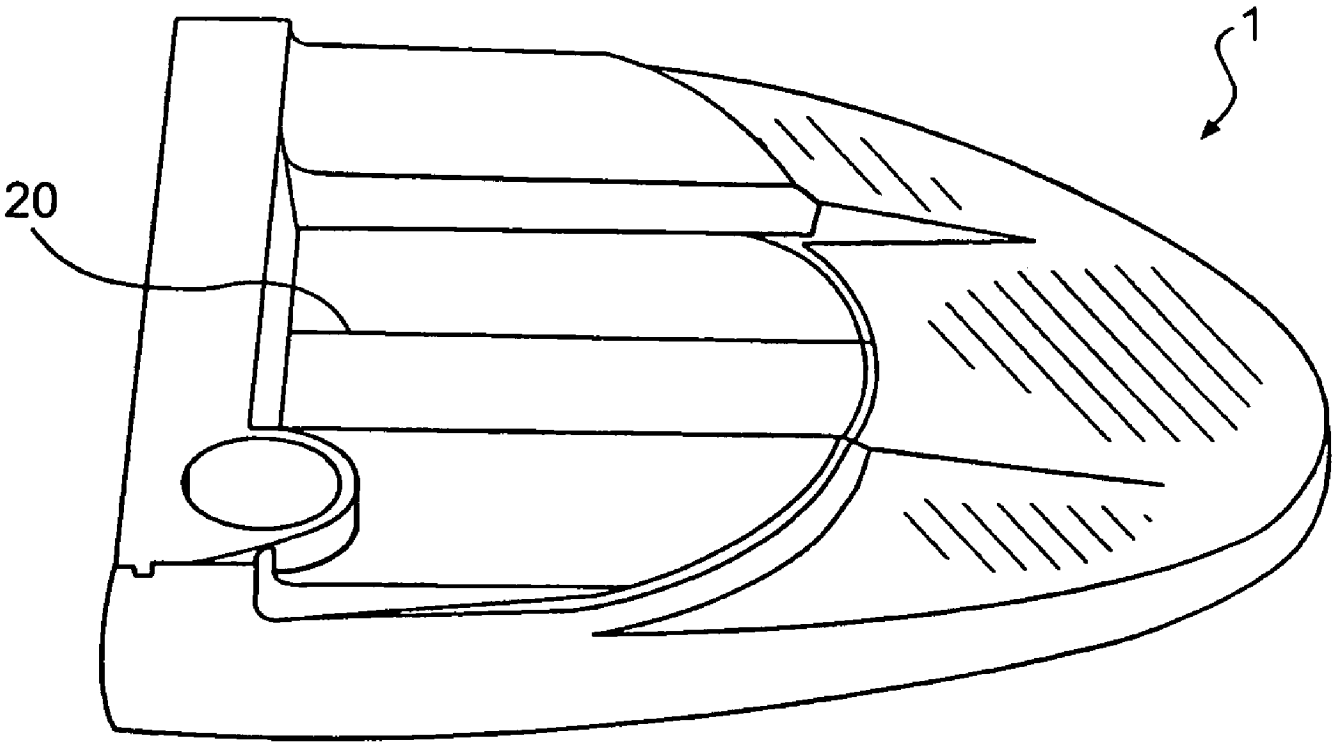
FIG. 4 shows a top view of another golf club head of the present invention.

Club head 1 may include a sight line 20, as shown in FIG. 4. Sight line 20 helps the user line up the golf shot. Since it is substantially perpendicular to strike face 11, sight line 20 therefore indicates the preferred angle for striking the golf ball. Sight line 20 preferably passes over the club head center of gravity CG, so that striking the ball on the portion of strike face 11 opposite sight line 20 results in a true putt. Sight line 20 may be on only first body member 10, or it may be on both first body member 10 and second body member 14.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while the present invention has been described above with respect to a putter, the present invention may also be employed with other golf clubs, such as irons, woods, and metal woods. Thus the present invention should not be limited by the above-described exemplary embodiments, but should be defined only in accordance with the following claims and their equivalents.

What is claimed is:

1. A golf club head, comprising:

a first body member having a strike face, a rearward portion opposite said strike face, and a top portion having a first area, said first body member top portion being a first color; and a second body member coupled to said first body member rearward portion, said second body member having a top portion having a second area, said second body member top portion being a second color;

wherein said second color is substantially darker than said first color;

said first area and said second area combine to form a total top area; and wherein said first area comprises approximately two-thirds of said total top area and said second area comprises approximately one-third of said total top area.

2. The golf club head of claim 1, wherein said first color is substantially grey and said second color is substantially black.

3. The golf club head of claim 1, further comprising a weight member coupled to said second body member.

4. The golf club head of claim 1, wherein said strike face is integral with said first body member.

5. The golf club head of claim 1, wherein said second body member is integral. with said first body member.

6. The golf club head of claim 1, wherein the golf club is a putter.

7. The golf club head of claim 1, wherein:

said first color has an L* value of approximately 35 to approximately 100; and said second color has an L* value of approximately 2 to approximately 35.

8. The golf club head of claim 7, wherein said first color has an L* value of approximately 40 to approximately 60.

9. The golf club head of claim 7, wherein said first color has an L* value of approximately 45.

10. The golf club head of claim 9, wherein said second color has an L* value of approximately 20 to approximately 30.

11. The golf club head of claim 10, wherein said second color has an L* value of approximately 25.

12. The golf club head of claim 7, wherein:

said first color has an L* value of approximately 40 to approximately 60; and said second color has an L* value of approximately 20 to approximately 30.

13. A golf club head, comprising:

a first body member having a strike face, a rearward portion opposite said strike face, and a top portion having a first area, said first area being a first color, said top portion including a toe portion and a crown portion; and a second body member coupled to said first body member rearward portion, said second body member having a top portion having a second area, said second area being a second color, said second color being different than said first color; and wherein:

said first area and said second area combine to form a total top area;

said first area comprises approximately 20% to approximately 80% of said total top area;

said second area comprises approximately 20% to approximately 80% of said total top area;

said first and second colors are chosen to give the club head an appearance of being smaller than it is;

the golf club head has a width;

said first area has a first depth, said first depth being approximately one-half to approximately one times said width;

said first area comprises approximately two-thirds of said total top area; and said second area comprises approximately one-third of said total top area.

14. The golf club head of claim 13, wherein:

said second area has a second depth; and said second depth is approximately one-half to approximately two times said first depth.

15. The golf club head of claim 14, wherein said second depth is approximately two-thirds times said first depth.

16. The golf club head of claim 13, wherein said first depth is approximately two-thirds times said width.

17. The golf club head of claim 13, wherein:

said second area has a second depth; and said first depth plus said second depth is approximately one-half to one times said width.

18. The golf club head of claim 17, wherein said first depth plus said second depth is approximately three-quarters to approximately one times said width.

19. The golf club head of claim 13, wherein said toe portion includes a toe area and said crown portion includes a crown area, said toe area comprising approximately 10% to approximately 50% of said total top area.

20. The golf club head of claim 13, wherein said second color is substantially darker than said first color.

21. The golf club head of claim 13, wherein said strike face is integral with said first body member.

22. The golf club head of claim 13, wherein said second body member is integral with said first body member.

23. The golf club head of claim 13, wherein the golf club is a putter.

24. A golf club head, comprising:

a first body member having a strike face, a rearward portion opposite said strike face, and a top portion, said first body member top portion being a first color; and a second body member coupled to said first body member rearward portion, said second body member having a top portion of a second color;

wherein said second color is substantially darker than said first color; and wherein the club head has a center of gravity, said center of gravity located a distance of approximately three-and-three-quarters inches back from said strike face.

25. The golf club head of claim 24, wherein the golf club has a moment of inertia measured about a substantially vertical axis passing through said center of gravity when the golf club head is on a substantially horizontal surface, said moment of inertia being approximately 4000 $g \cdot cm^2$ to approximately 6000 $g \cdot cm^2$.

26. The golf club head of claim 25, wherein said moment of inertia is approximately 4750 $g \cdot cm^2$ to 5250 $g \cdot cm^2$.

27. The golf club head of claim 24, wherein the golf club has a moment of inertia measured about a substantially horizontal axis passing through said center of gravity and substantially perpendicular to said strike face when the golf club head is on a substantially horizontal surface, said moment of inertia being approximately 2500 $g \cdot cm^2$ to approximately 4500 $g \cdot cm^2$.

28. The golf club head of claim 27, wherein said moment of inertia is approximately 2800 $g \cdot cm^2$ to 3500 $g \cdot cm^2$.

29. The golf club head of claim 24, wherein the golf club has a moment of inertia measured about a substantially horizontal axis passing through said center of gravity and substantially parallel to said strike face when the golf club head is on a substantially horizontal surface, said moment of inertia being approximately 2000 $g \cdot cm^2$ to approximately 3000 $g \cdot cm^2$.

30. The golf club head of claim 29, wherein said moment of inertia is approximately 2300 $g \cdot cm^2$ to 2500 $g \cdot cm^2$.

31. The golf club head of claim 24, further including a sight line.

32. The golf club head of claim 31, wherein said sight line is on said first body member.

33. The golf club head of claim 24, wherein said strike face is integral with said first body member.

34. The golf club head of claim 24, wherein said second body member is integral with said first body member.

* * * * *